US010214977B2

(12) United States Patent
Pilgrim

(10) Patent No.: US 10,214,977 B2
(45) **Date of Patent: *Feb. 26, 2019**

(54) AUTOMATED PIPE TRIPPING APPARATUS AND METHODS

(71) Applicant: ENSCO SERVICES LIMITED, London (GB)

(72) Inventor: Rick Pilgrim, Houston, TX (US)

(73) Assignee: Ensco Services Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/259,869

(22) Filed: Sep. 8, 2016

(65) Prior Publication Data

US 2016/0376857 A1 Dec. 29, 2016

Related U.S. Application Data

(63) Continuation of application No. 14/060,104, filed on Oct. 22, 2013, now Pat. No. 9,441,427.

(Continued)

(51) Int. Cl.
*E21B 19/20* (2006.01)
*E21B 44/02* (2006.01)

(Continued)

(52) U.S. Cl.
CPC ..... *E21B 19/20* (2013.01); *E21B 3/02* (2013.01); *E21B 17/00* (2013.01); *E21B 17/01* (2013.01);

(Continued)

(58) Field of Classification Search
CPC ..... E21B 17/00; E21B 17/01; E21B 19/06; E21B 19/08; E21B 19/081; E21B 19/083;

(Continued)

(56) References Cited

U.S. PATENT DOCUMENTS 3,404,741 A * 10/1968 Dogaru ..... E21B 19/20 166/77.53
3,961,399 A * 6/1976 Boyadjieff ..... E21B 19/10 188/67

(Continued)

FOREIGN PATENT DOCUMENTS

CN 202017480 10/2011
WO 1984001599 4/1984

OTHER PUBLICATIONS

Grinrod, Mads. "Continuous Motion Rig: A Step Change in Drilling Equipment," IADC/SEP 128253, Well System Technology A/S, 2010, 5 pps.

(Continued)

*Primary Examiner* — Blake E Michener
*Assistant Examiner* — Christopher J Sebesta
(74) *Attorney, Agent, or Firm* — Fletcher Yoder, P.C.

(57) ABSTRACT

An automated pipe tripping apparatus includes an outer frame and an inner frame. The inner frame includes a tripping slips and iron roughneck. The automated pipe tripping apparatus may, in concert with an elevator and drawworks, trip in a tubular string in a continuous motion. The tripping slips and iron roughneck, along with the inner frame, may travel vertically within the outer frame. The weight of the tubular string is transferred between the tripping slips and the elevator. The iron roughneck may make up or break out threaded connections between tubular segments, the upper tubular segment supported by the elevator and the lower by the tripping slips. An automated pipe handling apparatus may remove or supply sections of pipe from or to the elevator. A control system may control both the automated pipe tripping apparatus and the elevator and drawworks.

5 Claims, 13 Drawing Sheets

Related U.S. Application Data

(60) Provisional application No. 61/716,980, filed on Oct. 22, 2012.

(51) Int. Cl.

| | |
|---|---|
| ***E21B 19/08*** | (2006.01) |
| ***E21B 19/086*** | (2006.01) |
| ***E21B 3/02*** | (2006.01) |
| ***E21B 17/00*** | (2006.01) |
| ***E21B 17/01*** | (2006.01) |
| ***E21B 19/06*** | (2006.01) |
| ***E21B 19/081*** | (2006.01) |
| ***E21B 19/083*** | (2006.01) |
| ***E21B 19/084*** | (2006.01) |
| ***E21B 19/10*** | (2006.01) |
| ***E21B 19/16*** | (2006.01) |
| ***E21B 21/08*** | (2006.01) |

(52) U.S. Cl.
CPC ..... *E21B 19/06* (2013.01); *E21B 19/08* (2013.01); *E21B 19/081* (2013.01); *E21B 19/083* (2013.01); *E21B 19/084* (2013.01); *E21B 19/086* (2013.01); *E21B 19/10* (2013.01); *E21B 19/161* (2013.01); *E21B 21/08* (2013.01); *E21B 44/02* (2013.01)

(58) Field of Classification Search
CPC ..... E21B 19/084; E21B 19/086; E21B 19/10; E21B 19/161; E21B 19/20; E21B 21/08; E21B 3/02; E21B 44/02
See application file for complete search history.

(56) References Cited

U.S. PATENT DOCUMENTS

| | | | | |
|---|---|---|---|---|
| 3,978,993 | A | 9/1976 | Howard | |
| 4,042,123 | A | 8/1977 | Sheldon et al. | |
| 4,531,875 | A | 7/1985 | Krueger | |
| 4,696,207 | A | 9/1987 | Boyadjieff | |
| 4,765,401 | A | 8/1988 | Boyadjieff | |
| 4,822,230 | A | 4/1989 | Sieltedal | |
| 4,951,759 | A | 8/1990 | Richardson | |
| 5,191,939 | A | 3/1993 | Stokley | |
| 5,244,329 | A | 9/1993 | McGill et al. | |
| 5,423,390 | A | 6/1995 | Donnally et al. | |
| 5,682,952 | A | 11/1997 | Stokley | |
| 6,349,764 | B1 | 2/2002 | Adams et al. | |
| 6,688,394 | B1 * | 2/2004 | Ayling | E21B 19/16 166/380 |
| 6,821,071 | B2 | 11/2004 | Woolslayer et al. | |
| 6,994,505 | B2 | 2/2006 | Hawkins, III | |
| 7,331,746 | B2 | 2/2008 | Wright et al. | |
| 7,540,338 | B2 * | 6/2009 | Belik | E21B 19/155 175/52 |
| 7,878,254 | B2 | 2/2011 | Abdollahi et al. | |
| 8,210,279 | B2 | 7/2012 | Tarique | |
| 2003/0221871 | A1 * | 12/2003 | Hamilton | E21B 19/14 175/85 |
| 2004/0240973 | A1 | 12/2004 | Andrews et al. | |
| 2005/0056122 | A1 * | 3/2005 | Belik | E21B 19/161 81/57.16 |
| 2005/0072882 | A1 * | 4/2005 | Mong | E21B 19/12 248/74.1 |
| 2005/0155757 | A1 | 7/2005 | Paton | |
| 2005/0238463 | A1 | 10/2005 | Smith | |
| 2007/0074606 | A1 * | 4/2007 | Halse | E21B 19/164 81/57.16 |
| 2008/0223418 | A1 | 9/2008 | Vante | |
| 2009/0294174 | A1 | 12/2009 | Harmer et al. | |
| 2010/0230115 | A1 * | 9/2010 | Belik | E21B 17/006 166/380 |
| 2010/0243325 | A1 | 9/2010 | Veeningen | |
| 2012/0181084 | A1 | 7/2012 | Pilgrim | |
| 2013/0025937 | A1 | 1/2013 | Pilgrim et al. | |
| 2013/0341036 | A1 | 12/2013 | Flusche | |

OTHER PUBLICATIONS

Grinrod, et al. "Continuous Motions Rig. A Detailed Study of a 750 Ton Capacity, 3600 m/hr Trip Speed Rig," SPE/IADC 139403, Weist Drilling Products AS, 2011, 10 pps "Automated Rig Equipment," http://www.weatherford.com/weatherford/groups/web/documents/weatherfordcorp/wft103221.pdf, 2012, 86 pps.

Brugman, "Automated Pipe Handing: A Fresh Approach," http://www.weatherford.com/weatherford/groups/web/documents/weatherfordcorp/wft103221.pdf, 2012, 2 pps.

Skjaerseth, "Continuous Motion Rig (CMR Technology)—A Step Change in Drilling Efficiency," OTC-25459-MS, WeST Drilling Product AS, 2014, 7 pps.

Chmela et al., "Safer Tripping Through Drilling Automation," https://www.onepetro.org/conference-paper/SPE-168018-MS, Apr. 24, 2014, 2 pps.

International Application No. PCT/US2013/066145, International Search Report and Written Opinion dated Aug. 18, 2014, 10 pps.

AU Application No. 21013334830 Examination Report dated Oct. 19, 2017, 7 pgs.

Australian Application No. 2013334830 Notice of Acceptance dated Aug. 1, 2018, 3 pgs.

* cited by examiner

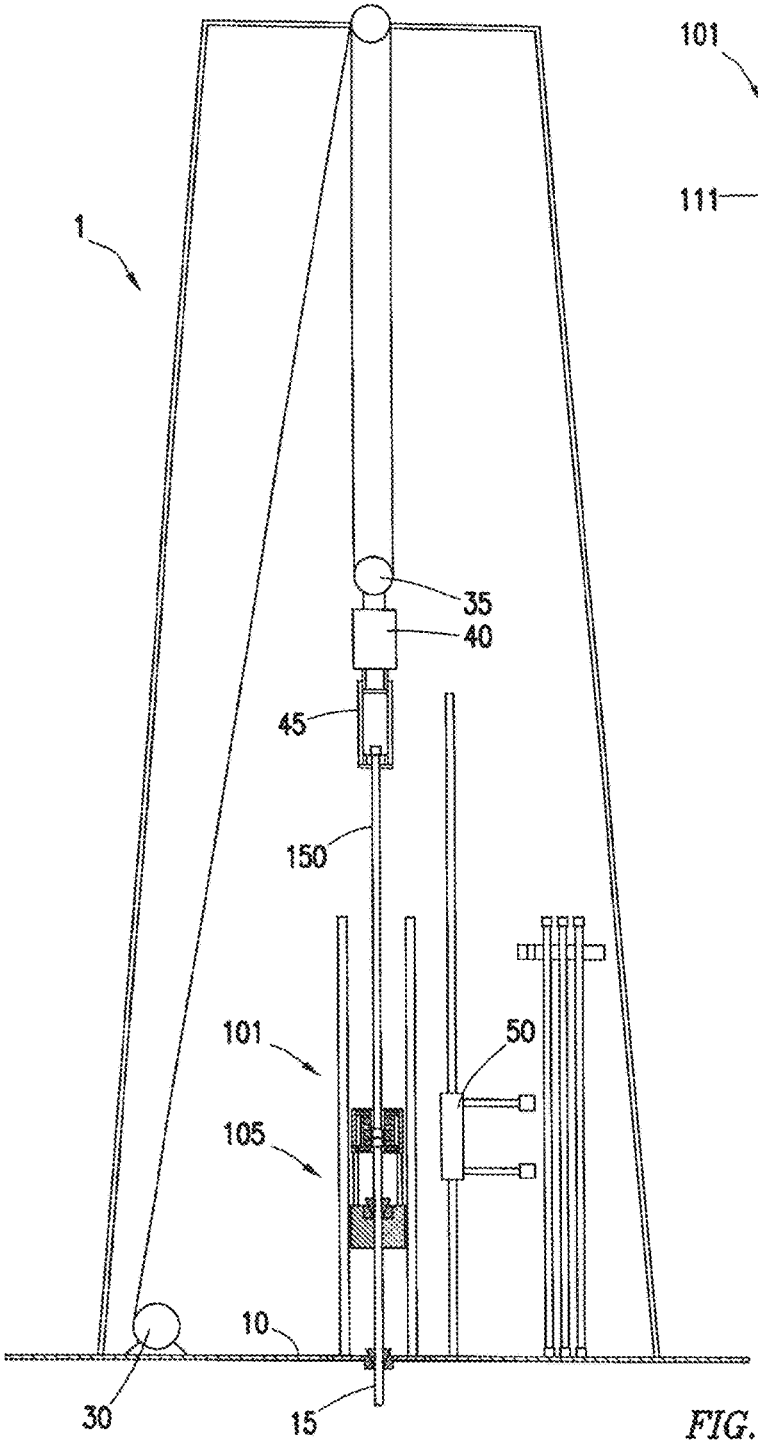
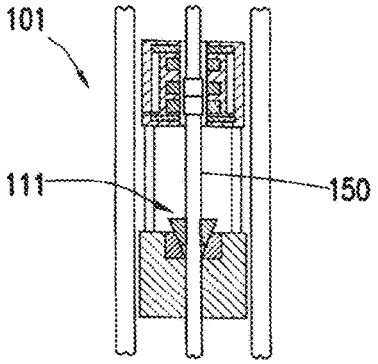
FIG. 7A
FIG. 7

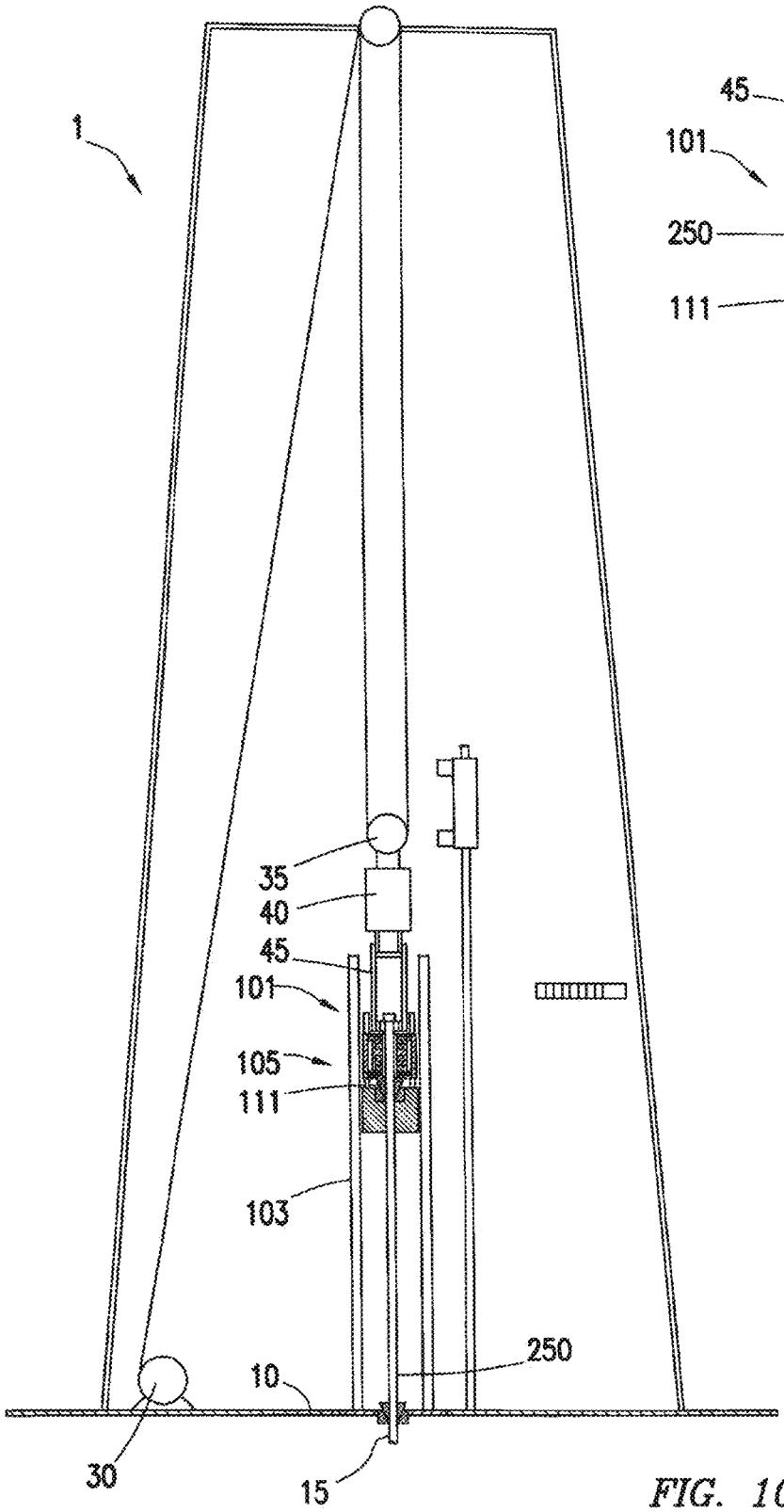
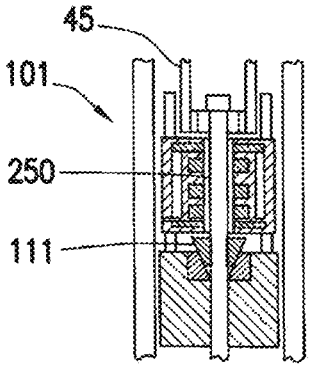
FIG. 10A
FIG. 10

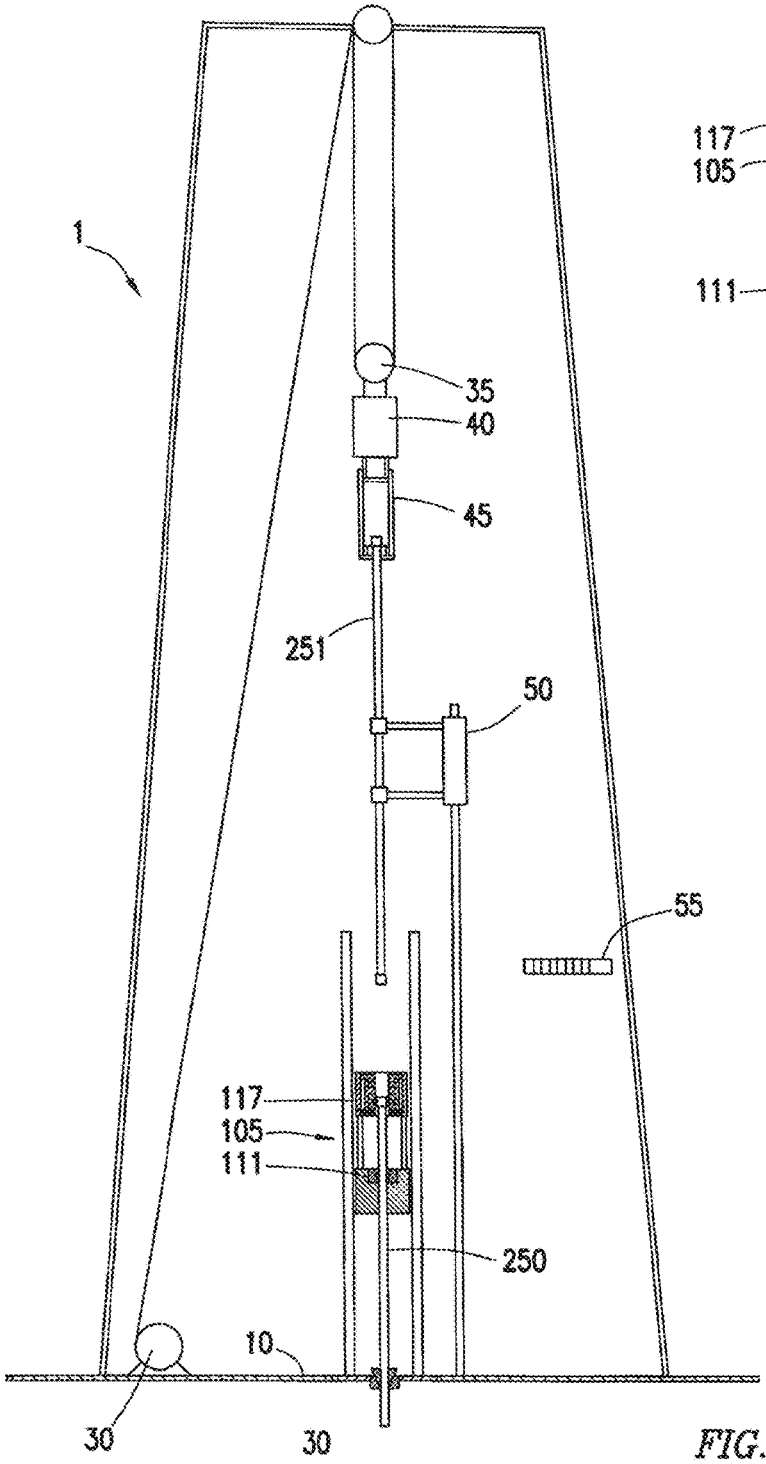
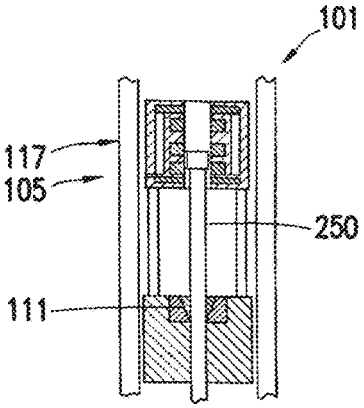
FIG. 12A
FIG. 12

AUTOMATED PIPE TRIPPING APPARATUS AND METHODS

CROSS-REFERENCE TO RELATED APPLICATIONS

The present application is a continuation of U.S. application Ser. No. 14/060,104, entitled "Automated Pipe Tripping Apparatus and Methods," and filed Oct. 22, 2013, now U.S. Pat. No. 9,441,427 which issued on Sep. 13, 2016, which claims priority to U.S. Provisional Patent Application No. 61/716,980, entitled "Automated Pipe Tripping Apparatus and Methods", filed Oct. 22, 2012, the entirety of which is incorporated by reference herein for all purposes.

TECHNICAL FIELD/FIELD OF THE DISCLOSURE

The present disclosure relates generally to handling tubular strings on a drilling rig, and in particular to making up and breaking out tubular strings during a tripping in or tripping out operation.

BACKGROUND OF THE DISCLOSURE

In the oil and gas industry, wells are drilled into the earth to reach reservoirs of hydrocarbons buried deep within the ground. In drilling, servicing, and completing wellbores, so-called pipe strings are utilized. Pipe strings, including drill strings, casing strings, tool strings, etc. are made up of lengths of threadedly connected pipe sections joined end to end to reach the potentially great depths of wellbores. As an example, in a drilling operation, the drill string may include a bottomhole assembly (BHA) which may include a drill bit, mud motor, and a measurement while drilling (MWD) sensor array, as well as various other sensors, spacers and communications apparatuses.

As drilling progresses deeper into the Earth, lengths of drilling pipe are added at the top of the drilling string. Generally, two or three 30 foot lengths of drilling pipe are connected into so-called pipe stands prior to being added to the drilling string. The drilling rig hangs the drilling string on a pipe slips and disconnects the drilling string from the drawworks. The drilling rig lifts the next pipe stand above the drilling string with the drawworks and threadedly connects it to the drilling string using, in some instances, an automated or "iron" roughneck to, among other things, reduce personnel exposed to potentially dangerous environments on the drilling floor.

At times, the entire tubular string must be removed from the wellbore. Such a "tripping out" operation may be required if, for example, a drill bit breaks, a tool lowered into the wellbore must be returned to the surface, or a wellbore reaches its target depth. At times, the same or a new tubular string must be run back into the wellbore. Such a "tripping in" operation may, for example, put the drill string with new drill bit back into the well, lower a downhole tool such as a packer, or insert a casing string into the wellbore to complete the well.

Since modern wells may become extremely deep, tripping out or tripping in operations may require a large number of threaded pipe joints to be disconnected (broken out) or connected (made up). Traditionally, the same drawworks, roughneck, and slips are used to make or break each connection. As the operation of a drilling rig can be extremely expensive, the need to trip in or trip out a tubular string may be a very costly operation. Additionally, damage may be caused to the wellbore simply by removing the tubular string from or inserting the tubular string into the wellbore. For instance, wellbore pressure may, in some circumstances, be rapidly increased or decreased by a rapid movement of a downhole tool. Commonly referred to as "swabbing", these pressure fluctuations may cause, for example, reservoir fluids to flow into the wellbore or may cause instability in a formation surrounding a wellbore.

SUMMARY

The present disclosure provides for an automated pipe tripping apparatus. The automated pipe tripping apparatus may include an outer frame, the outer frame including one or more vertical supports; an inner frame, the inner frame slidingly coupled to the outer frame and positioned to be moved vertically by a lifting mechanism coupled between the inner and outer frames. The inner frame may include a tripping slips, the tripping slips positioned to receive a tubular member and selectively grip and support the tubular member; and an iron roughneck, the iron roughneck positioned above the tripping slips and positioned to receive the tubular member and make up or break out a threaded joint between a first and a second segment of the tubular member.

The present disclosure further provides for a method of removing a tubular member from a tubular string being removed from a wellbore. The tubular string may be made up of a series of threadedly connected tubular members. The method may include providing an automated pipe tripping apparatus. The automated pipe tripping apparatus may include an outer frame, the outer frame including one or more vertical supports; an inner frame, the inner frame slidingly coupled to the outer frame and positioned to be moved vertically by a lifting mechanism coupled between the inner and outer frames. The inner frame may include a tripping slips, the tripping slips positioned to receive a tubular member and selectively grip and support the tubular member; and an iron roughneck, the iron roughneck positioned above the tripping slips and positioned to receive the tubular member and make up or break out a threaded joint between a first and a second segment of the tubular member. The iron roughneck may be selectively movable in a vertical direction between a lower and an upper position by a roughneck lifting mechanism. The method may further include positioning the automated pipe tripping apparatus on a drilling floor of a drilling rig above the wellbore, the drilling rig including a draw works, an elevator, an automated pipe handling device, and a drilling floor slips, the tubular string extending through the automated pipe tripping apparatus; lifting the tubular string with the elevator at a relatively constant speed defining a tripping speed; moving the inner frame downward; moving the iron roughneck into the upper position; moving the inner frame upwards at the tripping speed so that the iron roughneck is aligned with the threaded joint between the uppermost tubular member and the next tubular member; actuating the tripping slips; transferring the weight of the tubular string to the tripping slips; breaking out the threaded joint with the iron roughneck; lifting the uppermost tubular member away from the iron roughneck; removing the uppermost tubular member from the elevator by the automated pipe handling system; moving the iron roughneck to the lower position; moving the elevator downward; moving the elevator upward at the tripping speed so that the elevator may attach to the tubular string; transferring the weight of the tubular string to the elevator; and releasing the tripping slips.

The present disclosure further provides for a method of removing a tubular member from a tubular string being removed from a wellbore. The tubular string may be made up of a series of threadedly connected tubular members. The method may include providing an automated pipe tripping apparatus. The automated pipe tripping apparatus may include an outer frame, the outer frame including one or more vertical supports; an inner frame, the inner frame slidingly coupled to the outer frame and positioned to be moved vertically by a lifting mechanism coupled between the inner and outer frames. The inner frame may include a tripping slips, the tripping slips positioned to receive a tubular member and selectively grip and support the tubular member; and an iron roughneck, the iron roughneck positioned above the tripping slips and positioned to receive the tubular member and make up or break out a threaded joint between a first and a second segment of the tubular member. The iron roughneck may be selectively movable in a vertical direction between a lower and an upper position by a roughneck lifting mechanism. The method may further include positioning the automated pipe tripping apparatus on a drilling floor of a drilling rig above the wellbore, the drilling rig including a draw works, an elevator, an automated pipe handling device, and a drilling floor slips, the tubular string extending through the automated pipe tripping apparatus, the tubular string gripped by the tripping slips; moving the inner frame downwards at a relatively constant speed defining a tripping speed; moving the elevator upward; attaching an additional tubular member to the elevator by the automated pipe handling system; moving the iron roughneck into the upper position; moving the elevator downward at a speed higher than the tripping speed until the lower threaded connector of the additional tubular member aligns with the upper threaded connector of the tubular string, then moving the elevator downward generally at the tripping speed; making up the threaded joint between the additional tubular member and the tubular string with the iron roughneck; transferring the weight of the tubular string to the elevator; releasing the tripping slips; moving the inner frame upwards; moving the iron roughneck into the lower position; moving the inner frame downwards at the tripping speed so that the iron roughneck is aligned with the upper threaded joint of the additional tubular member; actuating the tripping slips; transferring the weight of the tubular string to the tripping slips; and releasing the additional tubular from the elevator.

The present disclosure further provides for an automated control system. The automated control system may include first code instructions that vary the speed of a tubular member moving into or out of a wellbore, the speed defining a tripping speed, the tripping speed varied in response to variations in pressure within the wellbore as measured by a pressure sensor at the end of the tubular member positioned within the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIGS. 3-8A depict operations consistent with a tripping in operation consistent with embodiments of the present disclosure.

FIGS. 9-12A depict operations consistent with a tripping out operation consistent with embodiments of the present disclosure.

DETAILED DESCRIPTION

Figure 1:
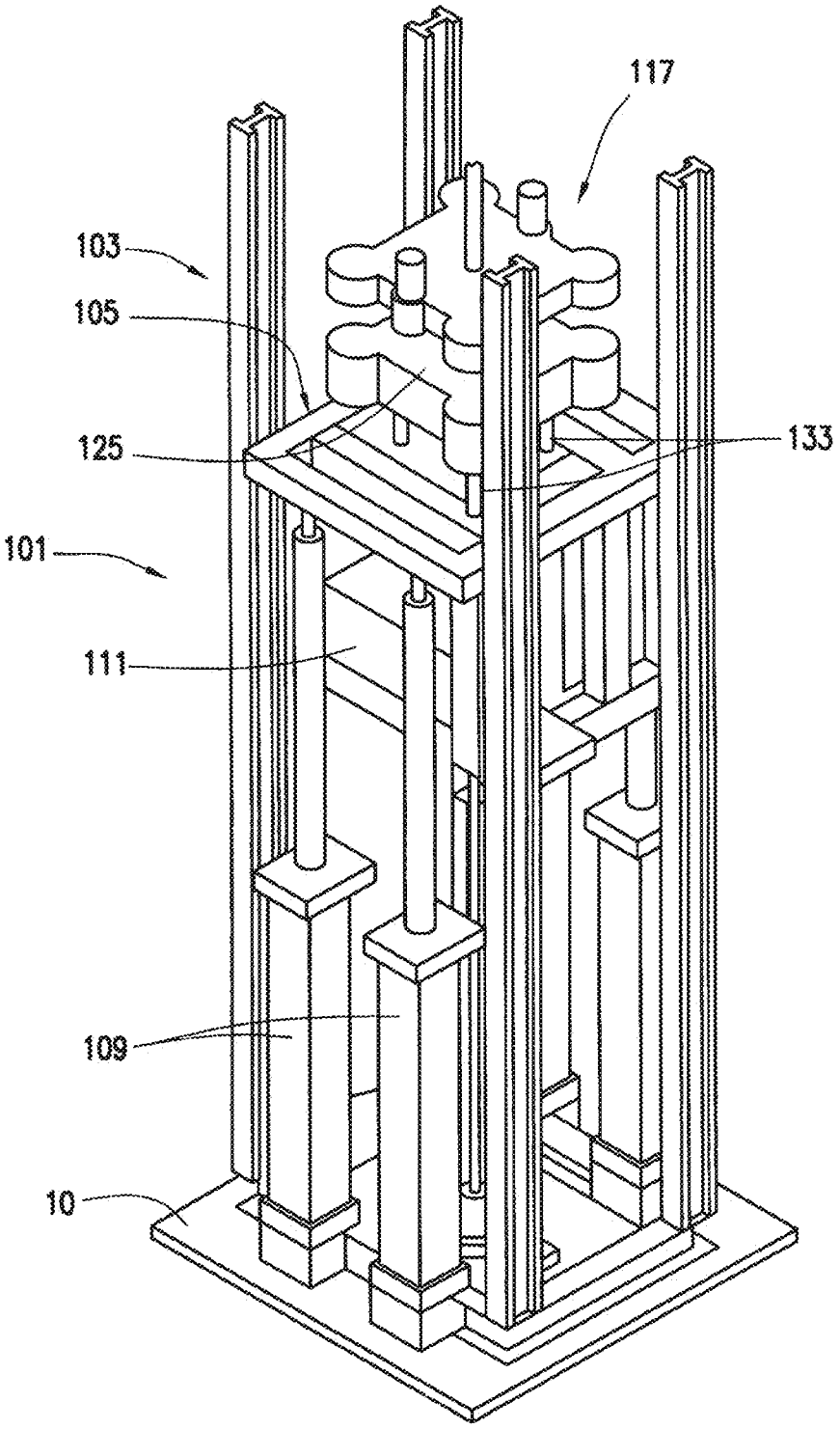
FIG. 1 is a perspective view of an automated pipe tripping apparatus consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

For the purposes of this disclosure, tubular segment and tubular string may refer to any interconnected series of tubulars for use in a wellbore, including without limitation, a drill string, casing string, tool string, etc. as well as multiple pre-connected segments of the same including so-called pipe stands.

Figure 2:
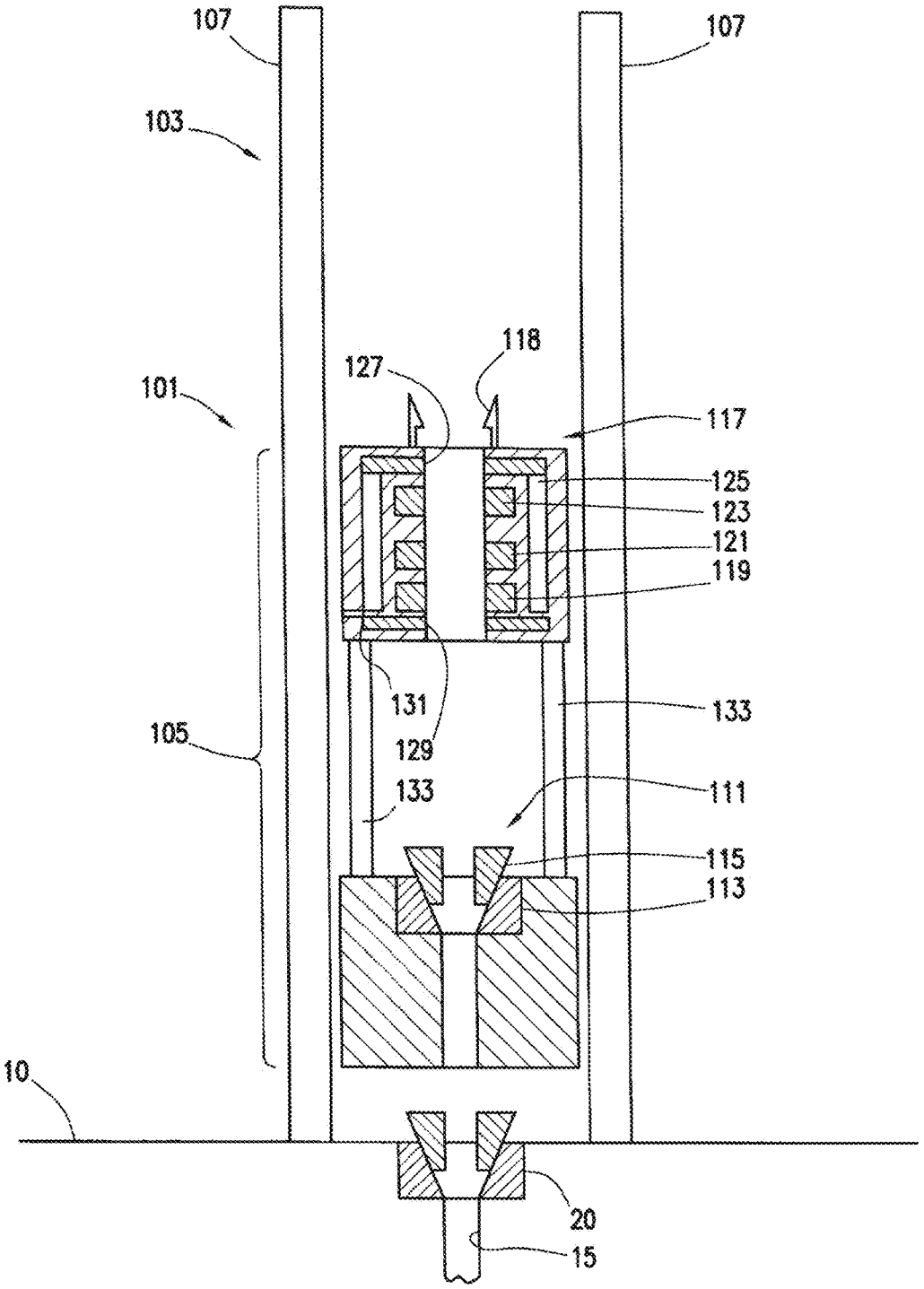
FIG. 2 is a cross-section view of the automated pipe tripping apparatus of FIG. 1.

FIGS. 1 and 2 depict an automated pipe tripping apparatus 101. Automated pipe tripping apparatus 101 may be positioned on drilling floor 10 of a drilling rig so that automated pipe tripping apparatus 101 is directly above wellbore 15. Automated pipe tripping apparatus 101 may, in some embodiments, be positioned directly on drilling floor 10. In other embodiments, automated pipe tripping apparatus 101 may be positioned to move away from a position over wellbore 15 by the use of, for example and without limitation, rails, rollers, racks, or any other suitable apparatus for sliding automated pipe tripping apparatus 101 horizontally along drilling floor 10. In some embodiments, automated pipe tripping apparatus 101 may include rollers (not shown) to ride along rails such as those used for an automated roughneck as known in the art. Automated pipe tripping apparatus 101 may use one or more motors (not shown) to propel itself along the rails, or may be driven by an external motor (not shown). In some embodiments, automated pipe tripping apparatus 101 may be retrofitted onto an existing drilling rig, and may utilize existing rails on floor 10 of the drilling rig.

Automated pipe tripping apparatus 101 may include outer frame 103 and inner frame 105. Outer frame 103 may include supports 107, the supports 107 running generally vertically. Inner frame 105 may be coupled to outer frame 103 and may be able to slide in a generally vertical direction within outer frame 103. In some embodiments, supports 107 may act as rails along which inner frame 105 may slide. In some embodiments, inner frame 105 includes one or more devices to reduce friction between inner frame 105 and supports 107, including and without limitation, bearings, rollers, bushings, etc. Although described as "outer" and "inner", one having ordinary skill in the art with the benefit of this disclosure will understand that outer frame 103 need not surround, completely encompass, or be entirely outside the outer perimeter of inner frame 105. In some embodiments, outer frame 107 may be coupled to top drive rail as understood in the art to, for example, locate automated pipe tripping apparatus 101 over wellbore 15.

Inner frame 105 is driven vertically within outer frame 103 by a lifting mechanism. In some embodiments, such as depicted in FIG. 1, the lifting mechanism may be one or more hydraulic pistons 109 coupled between outer frame 103 and inner frame 105. Although depicted as connecting to a lower end of outer frame 103 and pushing vertically upward, one having ordinary skill in the art with the benefit of this disclosure will understand that other configurations of hydraulic pistons 109 could be substituted without deviating from the scope of this disclosure.

In other embodiments, the lifting mechanism may be a jackscrew mechanism. In such an embodiment, outer frame 103 may include one or more motors, each driving a corresponding leadscrew as understood in the art. Each leadscrew runs generally vertically and is coupled to a leadscrew nut coupled to inner frame 105. As understood in the art, as the leadscrews are rotated, inner frame 105 moves up or down depending on the direction the leadscrews are rotated. One having ordinary skill in the art with the benefit of this disclosure will understand that any number of other lifting mechanisms may be substituted without deviating from the scope of this disclosure, and may include without limitation cable and pulleys, rack and pinion, linear actuators, etc.

In some embodiments, inner frame 105 may include tripping slips 111. Tripping slips 111 may include forcing ring 113 and slips jaws 115. Tripping slips 111, like traditional power slips commonly used on drilling rigs, may releasably grasp and support a tubular string (not shown) during times that the tubular string is disconnected from the top drive or draw works. Tripping slips 111 may be actuated hydraulically, electrically, pneumatically, or any other suitable method used to actuate a traditional power slips. Tripping slips 111 are positioned to move vertically as inner frame 105 moves vertically within outer frame 103. The operation of tripping slips 111 will be described below.

In some embodiments, inner frame 105 may also include iron roughneck 117. Iron roughneck 117, as understood in the art, is positioned to make up or break out a threaded connection between tubular members in a tubular string. Iron roughneck 117 may include fixed jaws 119, makeup/breakout jaws 121, and pipe spinner 123. As understood in the art, fixed jaws 119 may be positioned to grasp a lower tubular member below the threaded pipe joint to be made up or broken out. In an exemplary make-up operation, an upper tubular member is positioned coaxially with the lower tubular member. The pipe spinner provides a relatively high-speed, low-torque rotation to the upper tubular member, threading the upper and lower tubular members together. Makeup/breakout jaws 121 then engage to provide a low-speed, high-torque rotation to the upper tubular member to, for example, ensure a rigid connection between the tubular members. In an exemplary break-out operation, makeup/breakout jaws 121 engage the upper tubular member and impart a low-speed, high-torque rotation on the upper tubular member to initially loosen the threaded joint. Pipe spinner 123 then rotates the upper tubular member to finish detaching the tubular members.

In some embodiments, iron roughneck 117 may further include mud bucket 125. Mud bucket 125 may be positioned to confine drilling fluid which may be contained within an upper tubular member during a break-out operation to, for example, prevent the drilling fluid from spilling onto drill floor 10. In some embodiments, mud bucket 125 may enclose one or more of fixed jaws 119, makeup/breakout jaws 121, and/or pipe spinner 123. In some embodiments, mud bucket 125 may include upper and/or lower seals 127, 129 to, for example, prevent drilling fluid from flowing between mud bucket 125 and the tubular member. In some embodiments, upper and lower seals 127, 129 may be retractable to, for example, allow a tubular to pass through automated pipe tripping apparatus 101 without restriction. In some embodiments, the mud bucket 125 is coupled to drain line 131 which may allow drilling fluid contained within mud bucket 125 to return to a drilling fluid reservoir. In some embodiments, drain line 131 may be coupled to a vacuum pump to, for example, assist in removing drilling fluids from mud bucket 125.

In some embodiments, iron roughneck 117 may be permanently attached to automated pipe tripping apparatus 101. In other embodiments, iron roughneck 117 may be the same roughneck used during drilling operations of the drilling rig. In such an embodiment, iron roughneck 117, positioned directly on drill floor 10, may be repositioned onto inner frame 105 for use during a tripping operation. Inner frame 105 may include a platform adapted to detachably receive iron roughneck 117.

In some embodiments, iron roughneck 117 may be movable vertically within inner frame 105 relative to tripping slips 111 from an upper position (as depicted in FIG. 2) to a lower position. Iron roughneck 117 may be coupled to inner frame 105 by one or more iron roughneck supports 133, which may act as guide rails for the vertical movement of iron roughneck 117. Iron roughneck may be driven vertically by, for example and without limitation, hydraulic pistons, jackscrews, racks and pinions, cable and pulley, linear actuator, etc.

In some embodiments, iron roughneck 117 may include pipe centralizer 118 positioned to assist with the insertion of an upper tubular member into iron roughneck 117 during a makeup operation. In some embodiments, iron roughneck 117 may include a pipe doping system (not shown) positioned to apply lubricating fluid, known in the art as pipe dope, to the threads of a threaded connection to be made up by iron roughneck 117. In some embodiments, iron roughneck 117 may include a tubular filling apparatus as discussed below.

In some embodiments, automated pipe tripping apparatus 101 may include a control system capable of controlling each system of automated pipe tripping apparatus 101 including tripping slips 111, iron roughneck 117, the movement of inner frame 105, and the movement of iron roughneck 117. In some embodiments, the control system may additionally be capable of controlling other systems on the drilling rig including, for example and without limitation, a drawworks, top drive, elevator, elevator links, and pipe handling apparatus. In such an embodiment, automated pipe tripping apparatus 101 may be capable of autonomously tripping an entire tubular string with minimal operator input.

In order to illustrate the operation of the components of automated pipe tripping apparatus 101, an exemplary tripping in operation and an exemplary tripping out operation will be described below.

Figure 3:
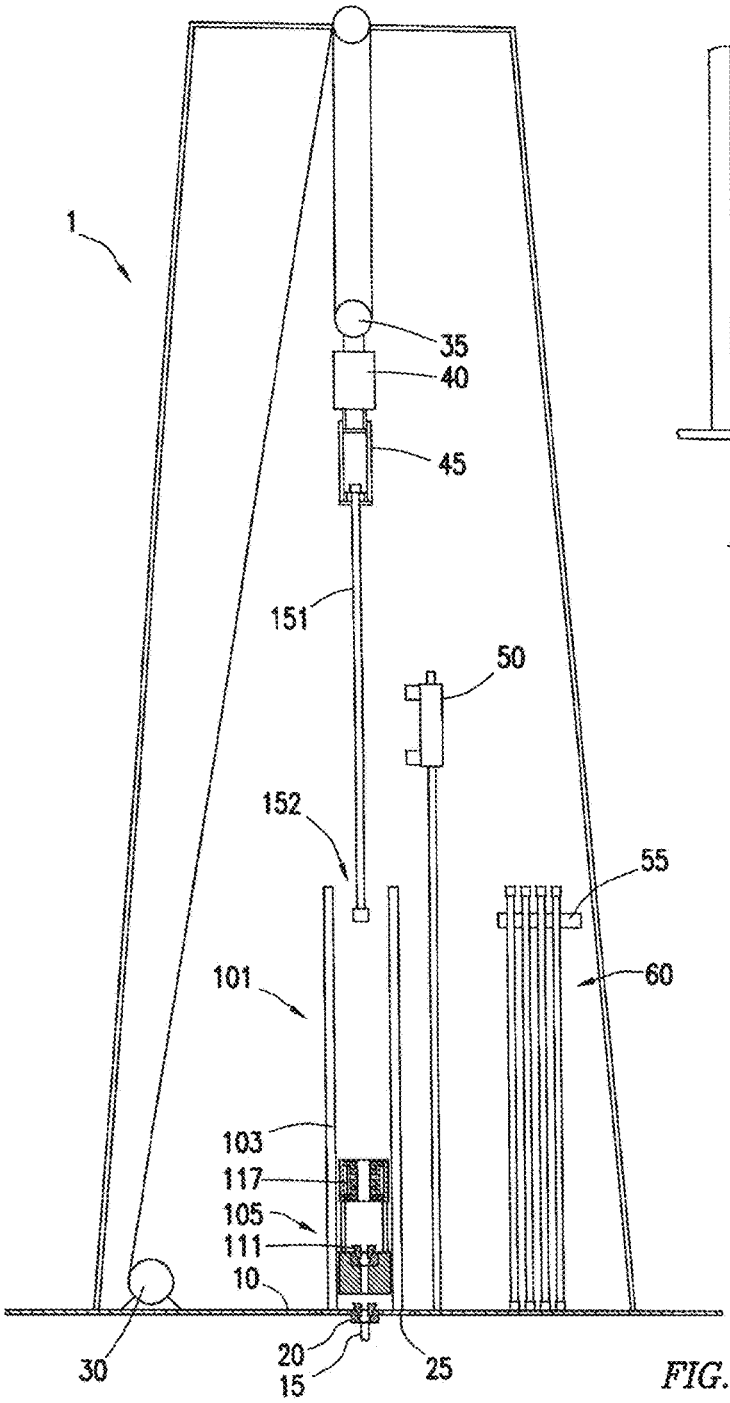
Figure 3A:
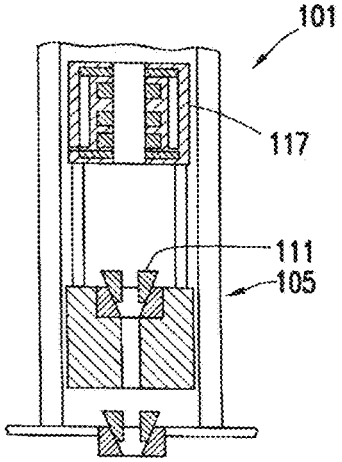

In a tripping in operation consistent with embodiments of the present disclosure, as depicted in FIGS. 3-8A, automated pipe tripping apparatus 101 is positioned on drilling floor 10 above wellbore 15 in drilling rig 1. Drilling rig 1 may include, as depicted in FIG. 3, drilling floor 10, rig floor slips 20 positioned in rotary table 25, drawworks 30, travelling block 35, top drive 40, elevator 45, automated pipe handling apparatus 50, and fingerboards 55. As understood in the art, drawworks 30 may be connected to top drive 40 via travelling block 35 and to move top drive 40 up and down within drilling rig 1. Elevator 45 may be coupled to top drive 40 and be positioned to connect to, suspend, and move a tubular segment within drilling rig 1. Elevator 45 may include one or more elevator links or bales which may be selectively actuatable to connect to the tubular segment. Automated pipe handling apparatus 50 serves to move pipe stands 60 between fingerboards 55 and elevator 45 during a tripping or drilling operation.

To begin the tripping in operation, automated pipe handling apparatus 50 may position a first tubular segment 151 to be supported by elevator 45. Elevator 45 supports first tubular segment 151 and lowers it toward wellbore 15. As elevator 45 lowers first tubular segment 151, inner frame 105 of automated pipe tripping apparatus 101 may move upward within outer frame 103 to an upper position. As inner frame 105 moves upward, iron roughneck 117 moves to the lower position to, for example, allow elevator 45 to properly position first tubular segment 151 within inner frame 105 as discussed below.

Figure 4:
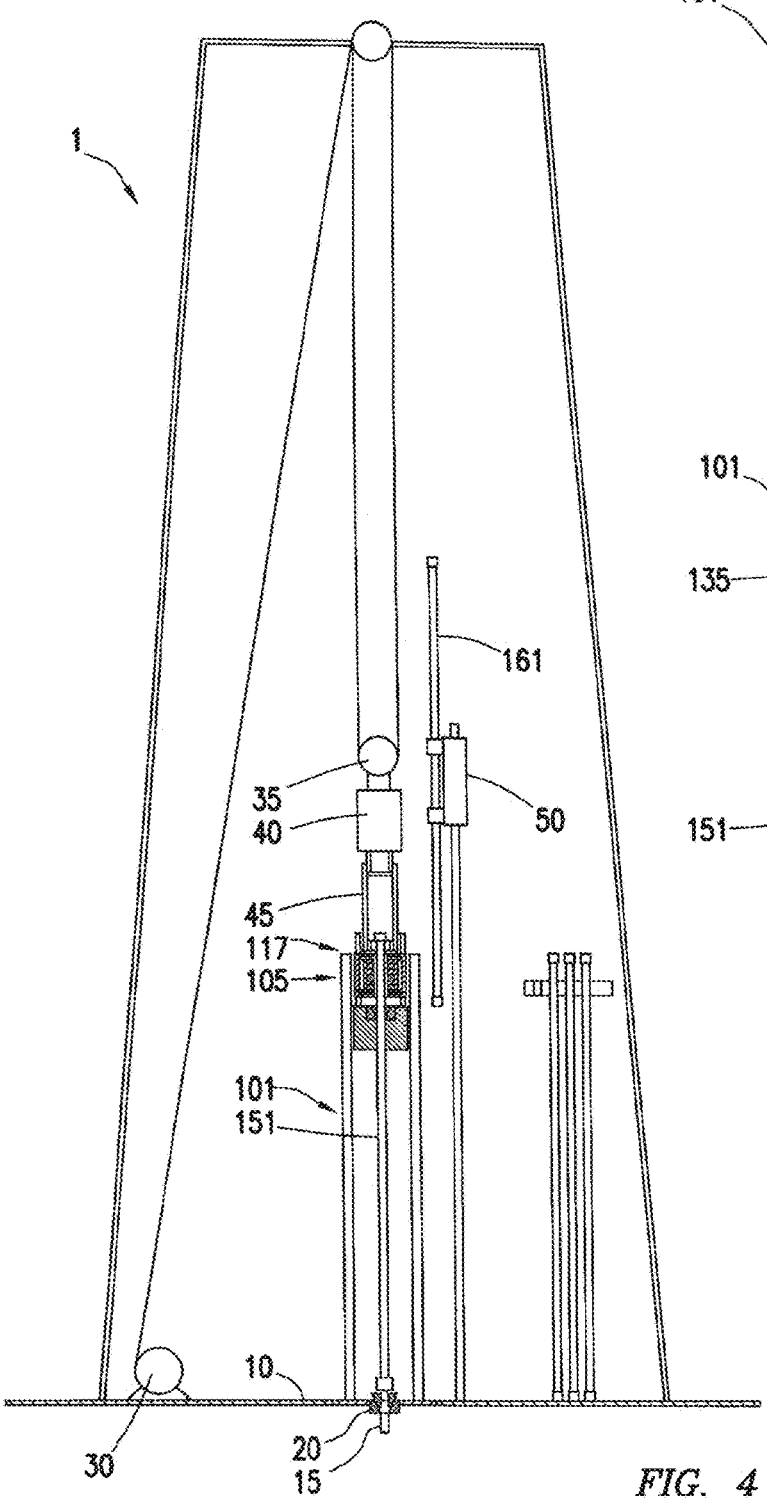
Figure 4A:
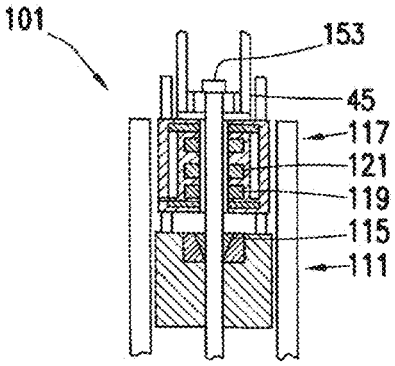

As depicted in FIGS. 4, 4A, as elevator 45 continues to move downward. At a certain point in the decent of first tubular segment 151 through automated pipe tripping apparatus 101, tripping slips 111 engage with first tubular segment 151. In some embodiments, as tripping slips 111 are engaged, inner frame 105 is moving downward at a rate equal to that of first tubular segment 151, thus allowing tripping slips 111 to engage with first tubular segment 151 as first tubular segment moves continuously downward. The position along first tubular segment 151 at which tripping slips 111 are engaged may be selected so that the upper threaded connector 153 of first tubular segment 151 is positioned at a height relative to inner frame 105 such that upper threaded connector 153 aligns to a point between fixed jaws 119 and makeup/breakout jaws 121 of iron roughneck 117 in its upper position.

Once tripping slips 111 have engaged first tubular segment 151, automated pipe tripping apparatus 101 is supporting first tubular segment 151, and elevator 45 may release it. Inner frame 105 continues to travel downward as elevator 45 releases first tubular segment 151, and lowers first tubular segment 151 into wellbore 15.

Figure 4B:
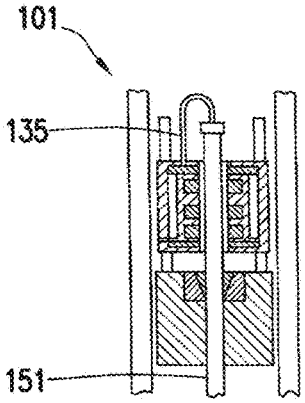

In some embodiments, a tubular filling apparatus may be included with automated pipe tripping apparatus 101. The tubular filling apparatus, as understood in the art, may be positioned to extend over the open end of a tubular segment to fill it with drilling fluid as it is added to the tubular string during a make up operation. In some embodiments, as depicted in FIG. 4B, the tubular filling apparatus may include gooseneck 135, which may extend over the open end of first tubular segment 151 and fill first tubular segment with drilling fluid. In some embodiments, gooseneck 135 may include a circulating packer, such as a TAM Casing Circulator (as produced by TAM International Inc.) connected to a drilling fluid supply pump on rig 1. In other embodiments, a tubular filling apparatus may be included as part of top drive 35.

Figure 5A:
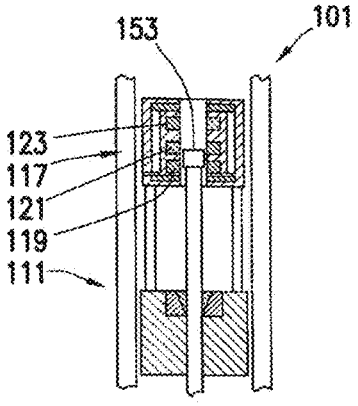
Figure 5:
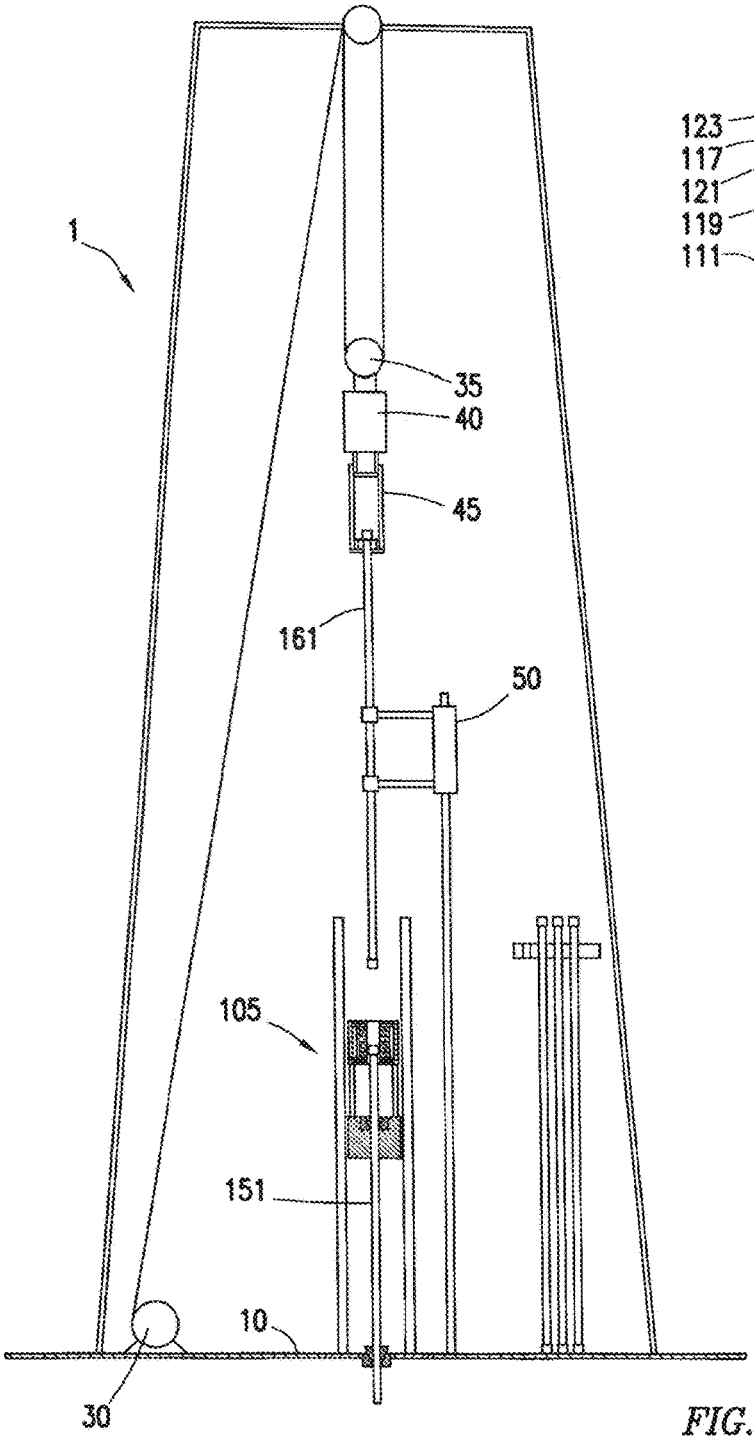

Once first tubular segment 151 is released from elevator 45, elevator 45 moves upward within drilling rig 1 as depicted in FIG. 5. Pipe handling apparatus 50 retrieves second tubular segment 161 from fingerboards 55 and delivers it to elevator 45. In some embodiments, pipe handling apparatus 50 may retrieve second tubular segment 161 concurrently with one or more of the previous operations, and, as depicted in FIG. 4, hold second tubular segment 161 in a "ready position" until elevator 45 is positioned to receive it.

After elevator 45 has moved away from automated pipe tripping apparatus 101, iron roughneck 117 extends to its upper position about first tubular segment 151 as depicted in FIGS. 5, 5A. As previously discussed, upper threaded connector 153 is aligned between fixed jaws 119 and makeup/breakout jaws 121. In some embodiments, the position of iron roughneck 117 may be fine-tuned by an upward or downward movement such that this positioning is achieved. As can be seen in FIG. 5, inner frame 105 has continued to move downward continuously during these operations.

Figure 6:
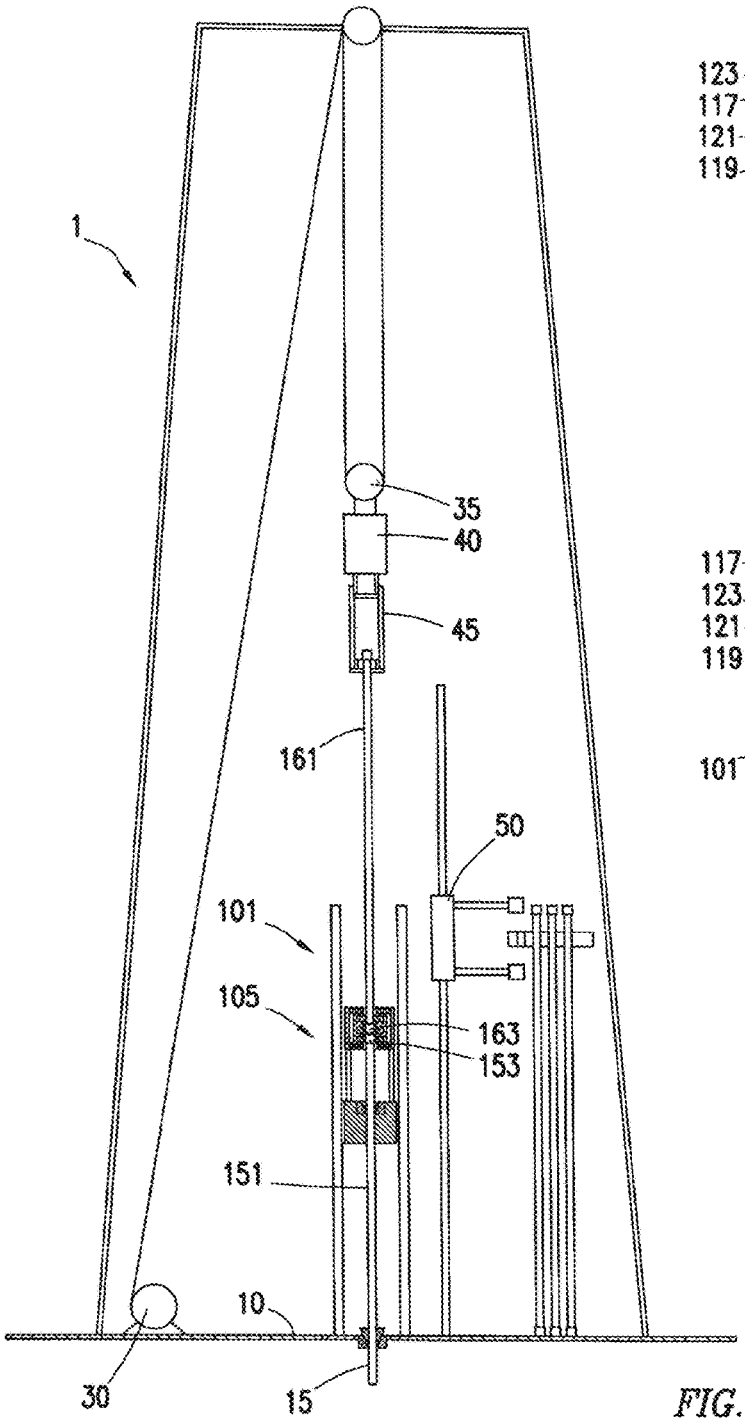
Figure 6A:
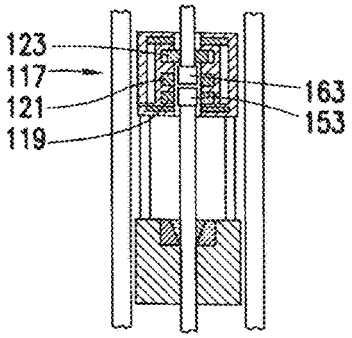
Figure 6B:
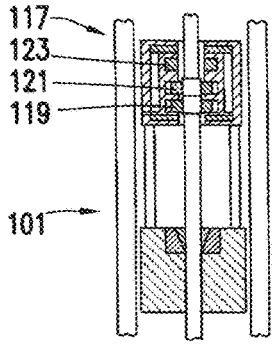

As depicted in FIG. 6, once elevator 45 has received second tubular segment 161, elevator 45 lowers second tubular segment 161 within drilling rig 1 at a rate faster than the decent of inner frame 105 until the lower threaded connector 163 of second tubular segment 161 is aligned with upper threaded connector 153 of first tubular segment 151, at which time elevator 45 descends at the same speed as inner frame 105. As depicted in FIGS. 6A, 6B, threaded connectors 153, 163 are then made-up by iron roughneck 117. In some embodiments, pipe spinner 123 rapidly engages a majority of the threads of threaded connections 153, 163. In other embodiments, top drive 40 may rotate second tubular segment 161. Makeup/breakout jaws 121—in combination with fixed jaws 119—apply high torque to complete the makeup operation.

Figure 8:
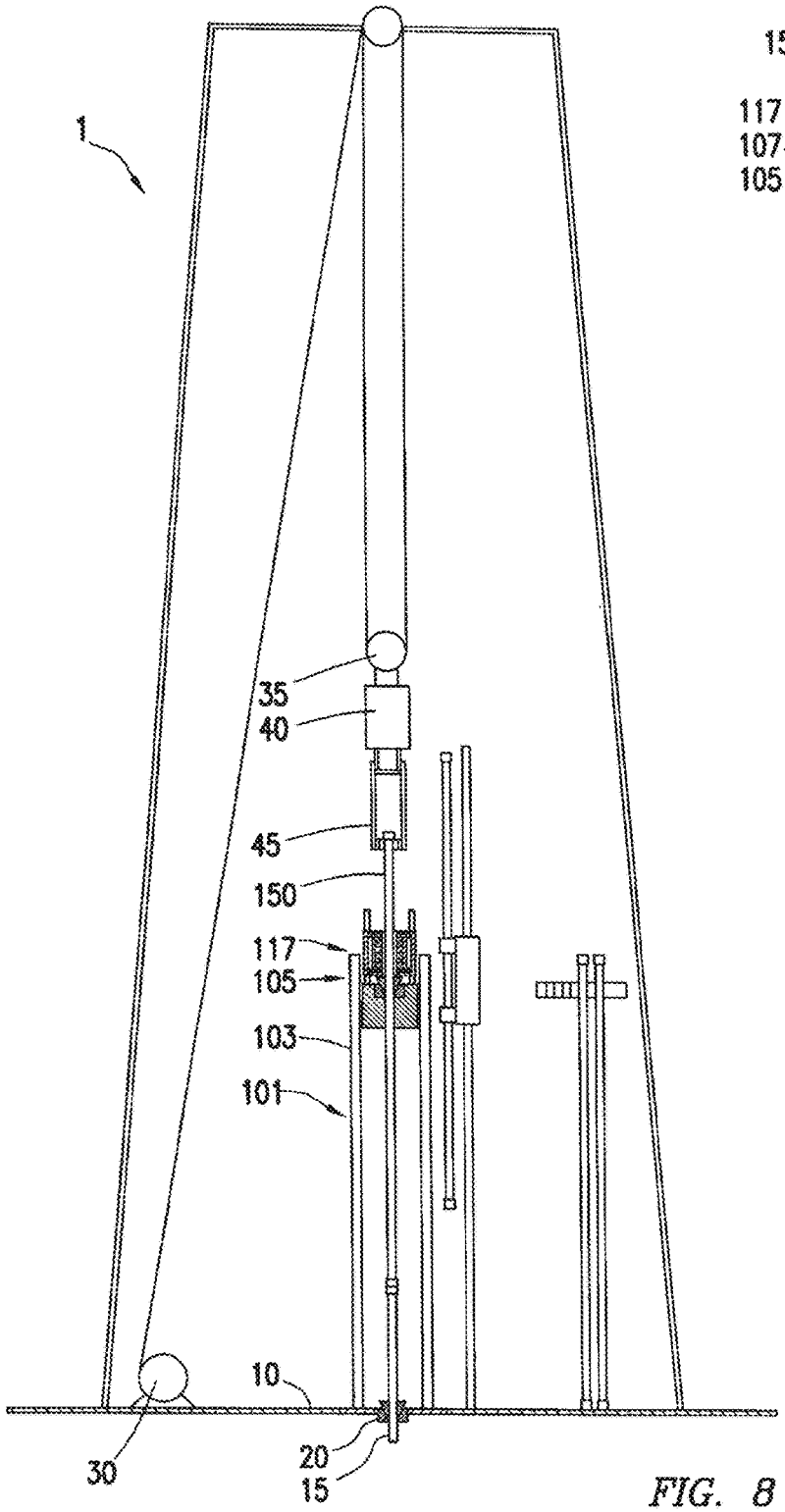
Figure 8A:
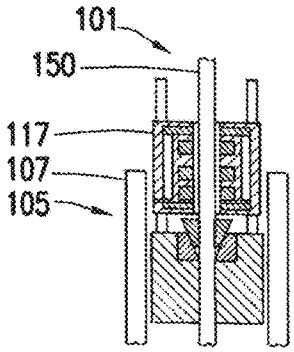

Once the connection is made, weight of tubular string 150 (now consisting of first and second tubular segments 151, 161) may be transferred entirely to elevator 45. Once elevator 45 supports tubular string 150, tripping slips 111 may disengage from tubular string 150 as depicted in FIGS. 7, 7A. Inner frame 105 may then travel upward within outer frame 103, while iron roughneck 117 moves back to its lower position as previously described as depicted in FIGS. 8, 8A, ready to receive the upper end of pipe string 150 as elevator 45 continues to descend. Pipe handling apparatus 50 may at the same time retrieve a third tubular segment 171 to be added to pipe string 150 in the next make-up operation.

The previously described process repeats for each tubular segment until tubular string 150 reaches the desired length in wellbore 15. At this point, rig floor slips 20 reengage tubular string 150. Inner frame 105 may move upward within outer frame 103 until it is higher than the uppermost end of tubular string 150. Automated pipe tripping apparatus 101 may then be moved away from the position over wellbore 15, and other rig operations may be performed, including for example, drilling, casing cementing, completion, etc.

Figure 9:
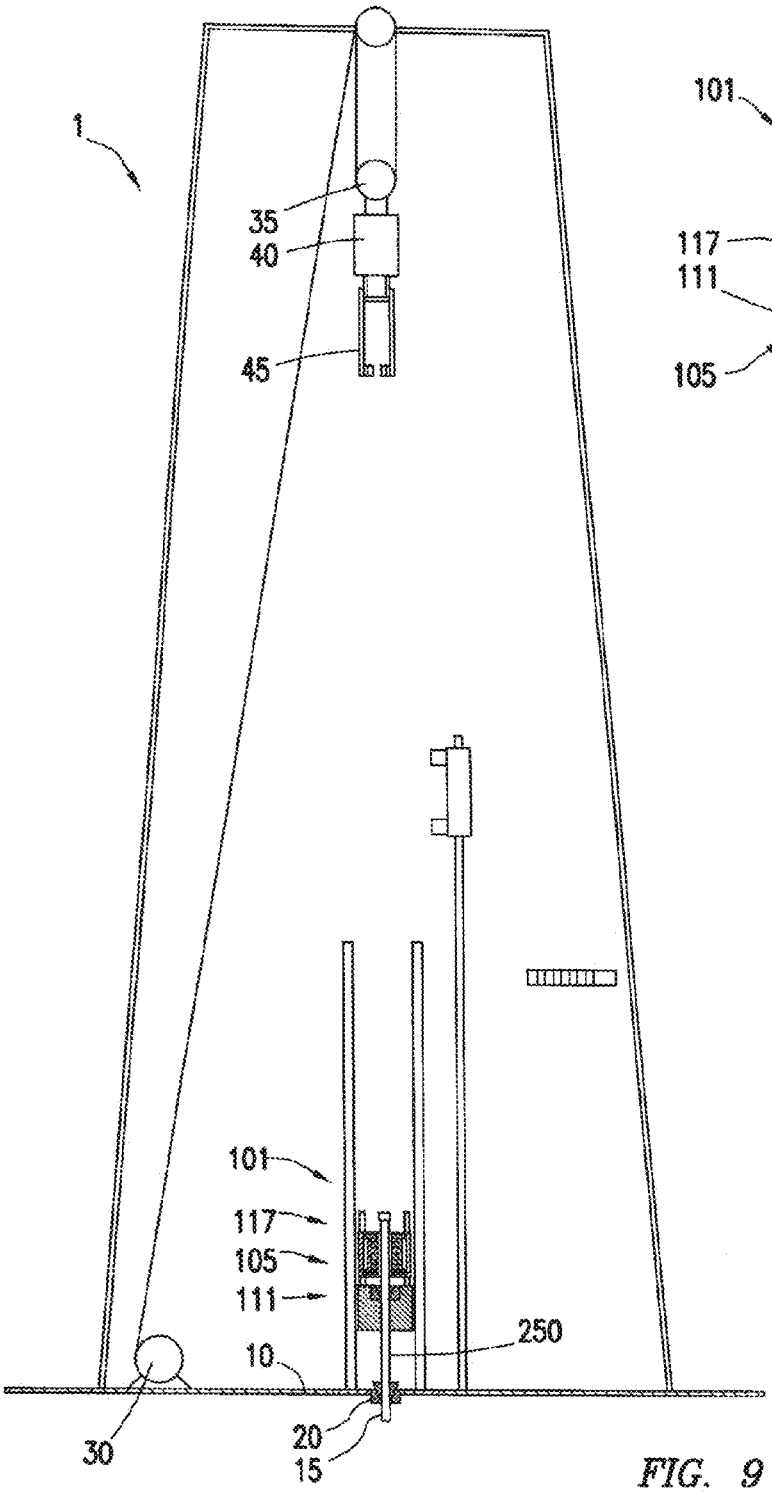
Figure 9A:
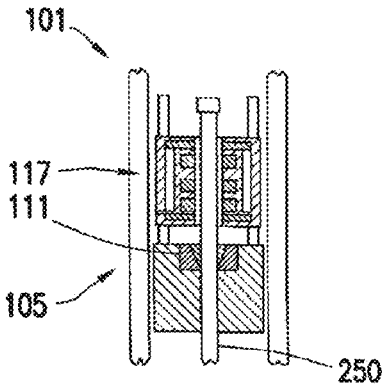

In a tripping out operation consistent with embodiments of the present disclosure, as depicted in FIGS. 9-12A, automated pipe tripping apparatus 101 is positioned on drilling floor 10 above wellbore 15 in drilling rig 1. As depicted in FIGS. 9, 9A, tubular string 250, held by rig floor slips 20, extends above drill floor 10 far enough such that elevator 45 can connect to the upper end of tubular string 250 above iron roughneck 117 in its lower position as previously described.

In some embodiments, with inner frame 105 in a lower position within outer frame 103, tripping slips 111 engage with tubular string 250, and tubular string 250 is first lifted by automated pipe tripping apparatus 101 as inner frame 105 is moved upward within outer frame 103. In other embodiments, elevator 45 engages with tubular string 250 and begins moving it upward. As tubular string 250 begins to be lifted from wellbore 15, rig floor slips 20 disengage, allowing either tripping slips 111 or elevator 45 to support the weight of tubular string 250.

As depicted in FIGS. 10, 10A, tubular string 250 is initially lifted by automated pipe tripping apparatus 101. As tubular string 250 moves upward, elevator 45, while moving upward at the same rate as inner frame 105, attaches to tubular string 250. The weight of tubular string 250 is transferred to elevator 45, and tripping slips 111 disengage.

Figure 11:
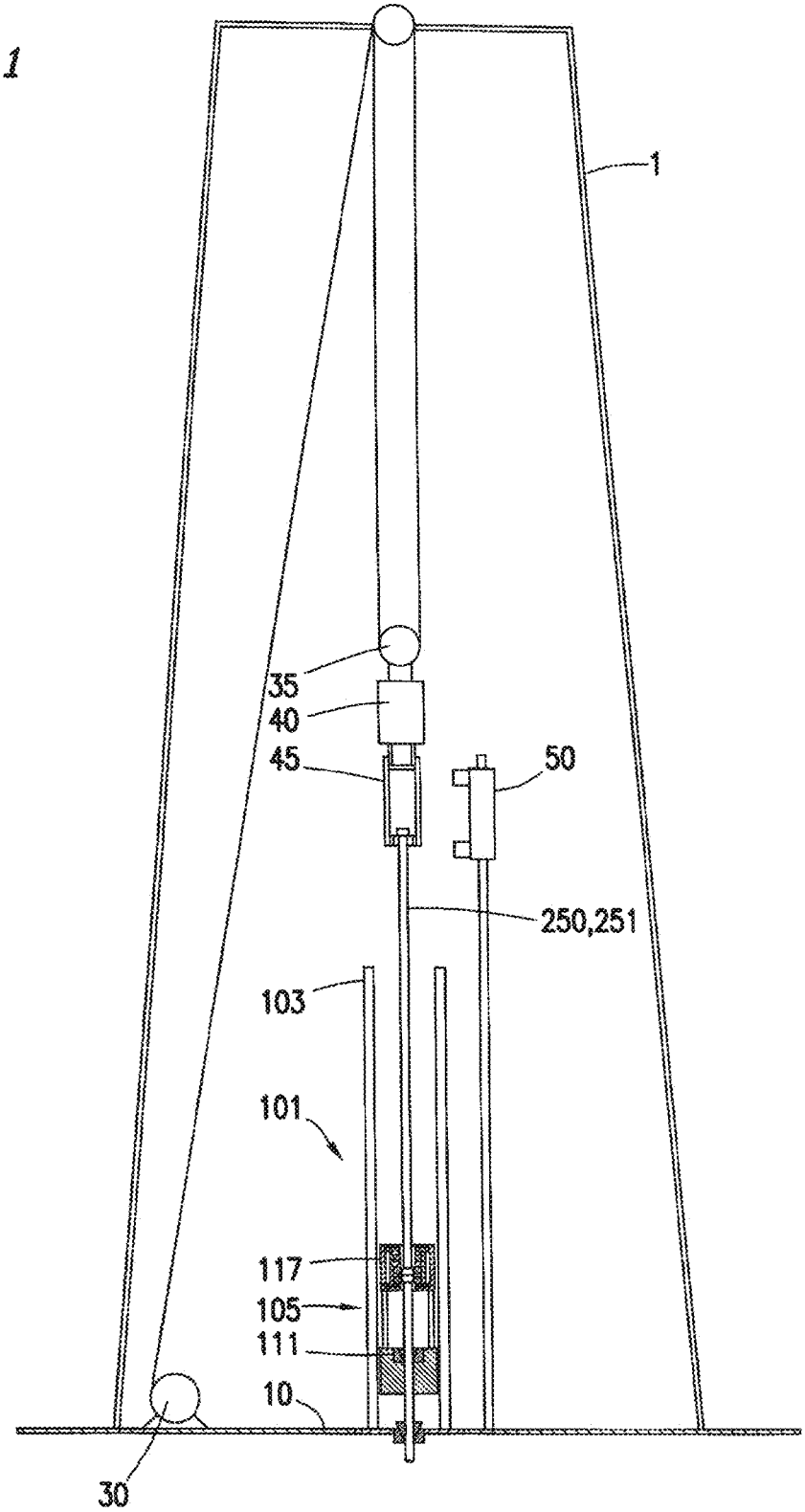

As elevator 45 continues to lift tubular string 250, inner frame 105 moves downward within outer frame 103, and iron roughneck 117 moves to its upper position as depicted in FIG. 11.

Figure 11C:
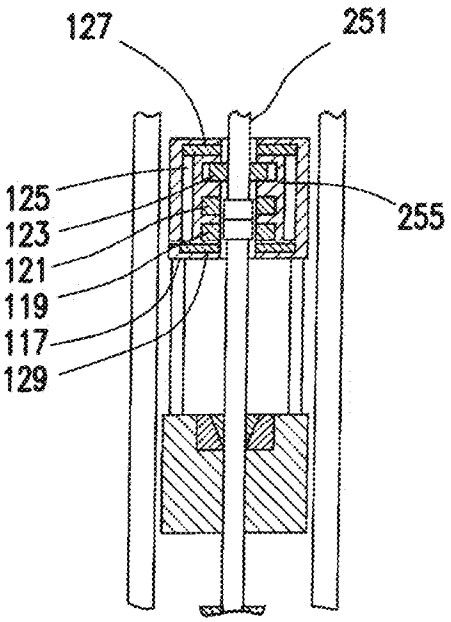

As tool joint 253 corresponding to the end of upper tubular segment 251 enters automated pipe tripping apparatus 101, when tool joint 253 is aligned with iron roughneck 117 as previously discussed, inner frame 105 moves upward at the same rate as elevator 45. As depicted in FIG. 11A, tripping slips 111 engage with tubular string 250, and a portion of the weight of pipe string 250 is taken by automated pipe tripping apparatus 101.

Figure 11B:
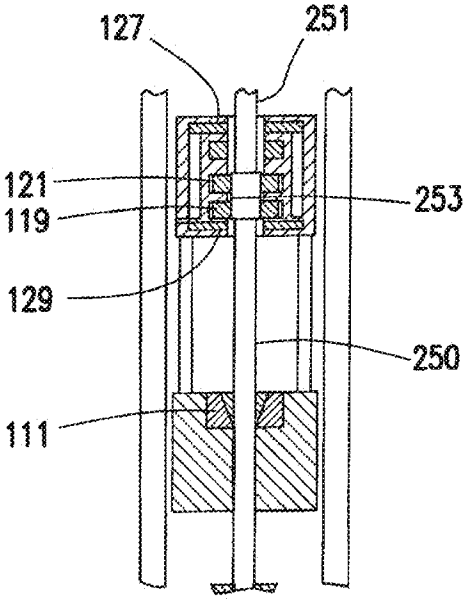
Figure 11A:
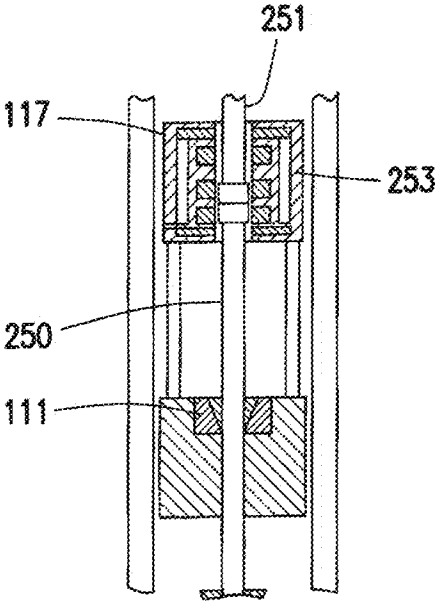

In embodiments which include them, upper and lower mud bucket seals 127, 129 are engaged at this point as depicted in FIG. 11B.

Iron roughneck 117 may then break out tool joint 253. Fixed jaws 119 and makeup/breakout jaws 121 engage tool joint 253, and apply high-torque to initially disconnect tool joint 253. In some embodiments, as depicted in FIG. 11C, pipe spinner 123 then rapidly finishes disconnecting tool joint 253. In other embodiments, top drive 40 may rotate upper tubular segment 251. Any drilling mud 255 contained in upper tubular segment 251 is released as tool joint 253 is broken out, and may be captured by mud bucket 125. Drilling mud 255 may then flow through a drain line (not shown) to, for example, be recycled into the drilling mud supply.

Once tool joint 253 is broken out, as depicted in FIGS. 12, 12A, elevator 45 increases in speed, and hoists upper tubular segment 251 above automated pipe handling apparatus 101. Automated pipe tripping apparatus 101 continues to lift tubular string 250 from wellbore 15. In some embodiments, automated pipe handler 50 then receives upper tubular segment 251 and delivers it to fingerboards 55. As inner frame 105 continues to lift tubular string 250, iron roughneck 117 moves to its lower position, as previously discussed.

The previously described process may then repeat for each tubular segment until tubular string 250 is entirely removed from wellbore 15. At this point, any procedure that necessitated the tripping out procedure may be undertaken, including without limitation replacing a bit, servicing a BHA, testing the well, perforating, etc. In some cases, automated pipe tripping apparatus 101 may be utilized in such a procedure, such as running casing, running a packer or other tool, or tripping back in a drill string with a replaced drill bit. In other cases, automated pipe tripping apparatus 101 may be removed from the drill floor directly above wellbore 15.

Because both elevator 45 and tripping slips 111 are capable of vertical movement, a tubular string being tripped in or out of a wellbore 15 may remain in continuous motion for the entire tripping process at a constant speed. Because the tubular string is in constant motion, the tubular string may be able to be tripped in the same amount as time as a traditional discontinuous tripping procedure while the tubular string remains at a slower speed than would be reached by a tubular string in a discontinuous tripping operation. In some circumstances, wellbore pressure may be rapidly increased or decreased by a rapid movement of a downhole tool. Commonly referred to as "surging" while tripping in, or "swabbing while tripping out, these pressure fluctuations may cause, for example, reservoir fluids to flow into the wellbore or cause instability in a formation surrounding a wellbore. By allowing the same distance of tubular string to be tripped in the same amount of time but at a slower speed may, for example, reduce the chance of wellbore damage from swabbing. Additionally, the continuous motion may help to prevent, for example, hydraulic shocks caused by rapid starting and stopping of a tubular string in the wellbore.

In some embodiments, the tripping speed, defined as the speed of the tubular string within the wellbore during a continuous tripping operation, may be predetermined by an operator. In other embodiments, tripping speed may be controlled by a closed-loop feedback mechanism. For example, in some embodiments, the closed-loop controller may take into account a pressure measured by a pressure sensor at the bottom of the tool string. By measuring the pressure and monitoring, for example, absolute pressure changes, rate of pressure change, and acceleration of pressure change, the controller may increase or reduce tripping speed to, for example, prevent surging or swabbing in the wellbore. In other embodiments, pressure in the wellbore may be inferred by measuring a drive current used by top drive 40 or the lifting mechanism.

Additionally, as previously mentioned, in some embodiments, the control system of automated pipe tripping apparatus 101 may control one or more of drawworks 30, top drive 40, elevator 45, and pipe handling apparatus 50. As such, the control system may additionally monitor the status of each of these systems and potentially modify tripping speed in response to, for example, environmental factors, system capabilities, tubular parameters, etc. The control system may also measure other factors and take them into account when determining tripping speed, such as the temperature at rig 1, the temperature within the wellbore, and the temperature of returning drilling fluids from the wellbore during a tripping operation. The control system may additionally measure the back pressure on the tubular filling apparatus.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method, comprising:

lifting a string at a relatively constant speed defining a tripping speed;

moving an inner frame downward with respect to an outer frame to a first location;

moving an iron roughneck relative to the inner frame into an upper position inside of the inner frame as the inner frame is moving downward with respect to the outer frame;

moving the inner frame upwards relative to the outer frame at the tripping speed to align the iron roughneck with a threaded joint of the string; and breaking out the threaded joint with the iron roughneck.

2. The method of claim 1, comprising:

transferring weight of the string to tripping slips; and lifting an uppermost member of the string away from the iron roughneck.

3. The method of claim 2, comprising moving the iron roughneck from the upper position inside of the inner frame to a lower position inside of the inner frame.

4. The method of claim 3, comprising:

moving an elevator upward at the tripping speed in conjunction with attaching the elevator to the string;

transferring the weight of the string to the elevator; and releasing the tripping slips from the string.

5. The method of claim system of claim 1, wherein breaking out the threaded joint comprises breaking out a portion of a drill string, a casing string, a tool string, or a riser string.

* * * * *